United States Patent [19]

Wecker et al.

[11] Patent Number: 4,543,727

[45] Date of Patent: Oct. 1, 1985

[54] DETERMINATION AND PASSING ON OF A TARGET DIRECTION FOR TANKS

[75] Inventors: Dietmar Wecker; Heinrich Lippold, both of Willebadessen, Fed. Rep. of Germany

[73] Assignee: IBP Pietzsch GmbH, Fed. Rep. of Germany

[21] Appl. No.: 482,062

[22] Filed: Apr. 5, 1983

[30] Foreign Application Priority Data

Apr. 6, 1982 [DE] Fed. Rep. of Germany ..... 3212729

[51] Int. Cl.[4] ..... G01C 21/00

[52] U.S. Cl. ..... 33/228; 33/277

[58] Field of Search ..... 33/277, 227, 228

[56] References Cited

U.S. PATENT DOCUMENTS 1,583,965 5/1926 Dunn ..... 33/277

2,263,101 11/1941 Perry ..... 33/277

FOREIGN PATENT DOCUMENTS 2457335 6/1976 Fed. Rep. of Germany .

*Primary Examiner*—Harry N. Haroian

*Attorney, Agent, or Firm*—L. Lawton Rogers, III

[57] ABSTRACT

In a method of determining the direction of a target by means of an optical square and passing on this direction to a magnifying sight for warfare tanks the exit window (4) of the optical square is provided with a vertical line of sight (8) and the entry window (1) with a sight aid (11). Marked areas (5, 10) in the exit window (4) have the effect that upon adjustment of the sight to the direction defined by the sight aid (11), the marked area positively will lie within the field of view of the magnifying sight.

5 Claims, 4 Drawing Figures

DETERMINATION AND PASSING ON OF A TARGET DIRECTION FOR TANKS

FIELD OF THE INVENTION

The instant invention relates to a method of and means for determining a target direction by an optical square and passing on the direction to a magnifying sight for warfare tanks. Sight in the present context is intended to designate any instrument of viewing, reconnaissance, aiming, or targeting in the optical and thermolocation fields.

DESCRIPTION OF PRIOR ART

Optical squares are used for observation of the field of view below hatch. Once a target has been discovered, it must be identified as quickly as possible by means of a magnifying sight. To this end the sight must be aimed at the target using the directional information obtained with the aid of the optical square.

Usually the tank commander estimates the direction of a target recognized in the optical square and passes it on to the gunner in the form of "clock data" based on a fundamental direction which is fixed with respect to the equipment. Or he may use a magnifying sight himself for target reconnaissance.

It is known to provide keys around the inner edge of the commander hatchway which, when pressed, cause the sight to run automatically into the direction determined by actuation of the respective key.

It is likewise known to coordinate such keys with optical squares and display the automatic running of the sight by light emitting diodes upon pressing of a key.

However, the known means have shortcomings:

The determination of the direction is inaccurate as sight means and directional data are missing in or at the optical square.

If the target direction is located between two keys the commander must decide which one to actuate. Frequently this results in digital errors.

If the observing eye is not located in the center of the hatchway, another error results which is difficult to control.

The resulting false positioning of the sight requires search procedures and corrections taking a lot of time.

SUMMARY OF THE INVENTION

It is, therefore, an object of the instant invention to provide optical squares with sight aids in such manner that the target discovered positively will be located in the field of view of the sight upon adjustment thereof. It is another object of the invention to devise the passing on of the target direction to a magnifying sight such that the target traced with the aid of the optical square definitely lies in the field of view of the sight once the latter has run into the corresponding direction.

These objects are met, in accordance with the invention, in that a vertical line of sight is arranged in the exit window of the optical square and sight aids are arranged in the entry window of the optical square.

In accordance with the invention, furthermore, a range is marked at either side of the line of sight in the exit window of the optical square, in response to the optical data, particularly the magnifying factor of the magnifying sight. The limits of the marked area are so selected that upon adjustment of the magnifying sight into the direction defined by the line of sight in the exit window and the sight aid in the entry window of the optical square, the marked area positively will lie in the field of view of the magnifying sight.

At the magnifying sight often the magnification factor can be switched over. In accordance with the invention, therefore, the limits of the marked area are adapted to the change of the magnification factor of the sight by a switch-over procedure, e.g. by displacing a marking strip in the exit window.

If switch-over of the magnification factor of the magnifying sight is effected between two fixed values, it is convenient to permit the constant simultaneous reading of the limits of the corresponding marked area in the exit window of the optical square, in accordance with the invention.

The change of the limits of the marked area of the field of view of the sight is facilitated by reflecting those limits into the optical square, in accordance with the invention.

If the magnification factor of the sight is variable, a further development of the invention provides for automatic adaptation of the limits of the marked area of the field of view.

In accordance with the invention a particularly effective sight aid in the entry window of the optical square is a displaceable mark which may consist, for instance, of a mechanical pointer or a symbol reflected into said window. The location of this mark which the observing commander lines up with the target and the line of sight in the exit window is sensed constantly, in accordance with the invention, and transmitted continuously to the sight where it is displayed.

In another modification according to the invention the sight aids in the entry window of the optical square are embodied by a number n of vertical lines, a direction each being associated firmly with each such line. A key is coordinated with each sight aid line. These keys, when actuated, cause the transmission of the directional data to the magnifying sight where it will be displayed. The number n depends on the arrangement, number, and field of view of the optical squares and also on the magnification factor of the magnifying sight. It is so selected that the corresponding fields of view of the magnifying sight overlap. For example, it may be $n=5$.

It is convenient to provide directional marks in the form of "clock data" spaced from one another by 15°, i.e. as "full and half hours" above the entry window of the optical square so as to obtain rough orientation and have a certain redundancy of auxiliary means for determining the target direction.

If the sight aid in the entry window of the optical square is a displaceable mark, as defined above, it is convenient to furnish the adjustment means of the mark in accordance with the invention with a releasing means which, when acuated, causes the magnifying sight to run automatically into the direction defined by the mark and the line of sight.

If the sight aid in the entry window consists of n sight aid lines, as specified above, and a key each is associated with each of these sight aid lines, actuation of the key may cause not only the transmission of the directional information to the sight but also the automatic running of the sight into the direction defined by the line of sight in the exit window and the sight aid line in the entry window.

The advantages achieved by the instant invention above all reside in the time gained between recognition and identification of a target because the invention makes sure that the target always will be located in the field of view of the magnifying sight upon adjustment or automatic running-in of the same according to the directional information obtained by means of the sight aids of the optical square.

The directional information derived by means of the sight aids of the optical square further may be used to have the weapon of the tank move into the direction of the target.

If the sight aid in the entry window consists of a displaceable mark whose position is sensed constantly, the continuous transmission of the respective direction of observation followed by the commander to the gunner's sight permits the gunner to join in the observation, if required, so as to be more rapidly ready to fire.

Another advantage the invention offers is that existing optical square systems can be equipped readily with the sight aids.

SHORT DESCRIPTION OF THE DRAWINGS

SPECIFIC DESCRIPTION OF PREFERRED EMBODIMENTS

Figure 2:
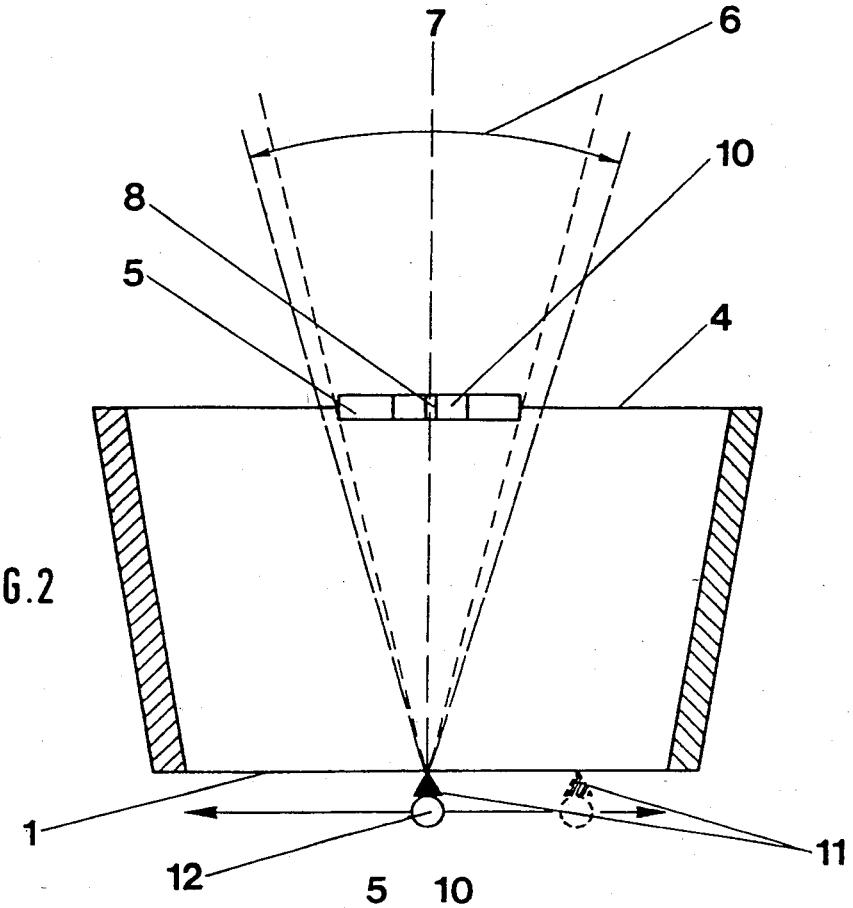
FIGS. 1 and 2 are diagrammatic presentations of an embodiment of the invention.

A line of sight 8 is located in the center of an exit window 4 of an optical square. A marked area 5 of the field of view of the magnifying sight, not shown, extends to the left and right of the line of sight. A smaller area 10 belonging to the field of view of the sight upon switch-over to a higher magnification factor is located within the area 5. The marked area 5 extends within the field of view 6 of the magnifying sight.

The direction 7 of observation is defined by the line of sight 8 in the exit window 4 and the displaceable mark 11 in the entry window 1.

The position of the displaceable mark 11 is sensed constantly by a means, not shown, and is available as directional information at the sight or for automatic running of the sight and/or a weapon into the desired direction by actuation of a releasing means provided at the adjustment means 12 of the mark 11.

Direction marks 9 indicating the direction as "time of the clock in full or half hours" are provided above the entry window 1 for rough orientation and as a kind of redundancy.

Figure 4:
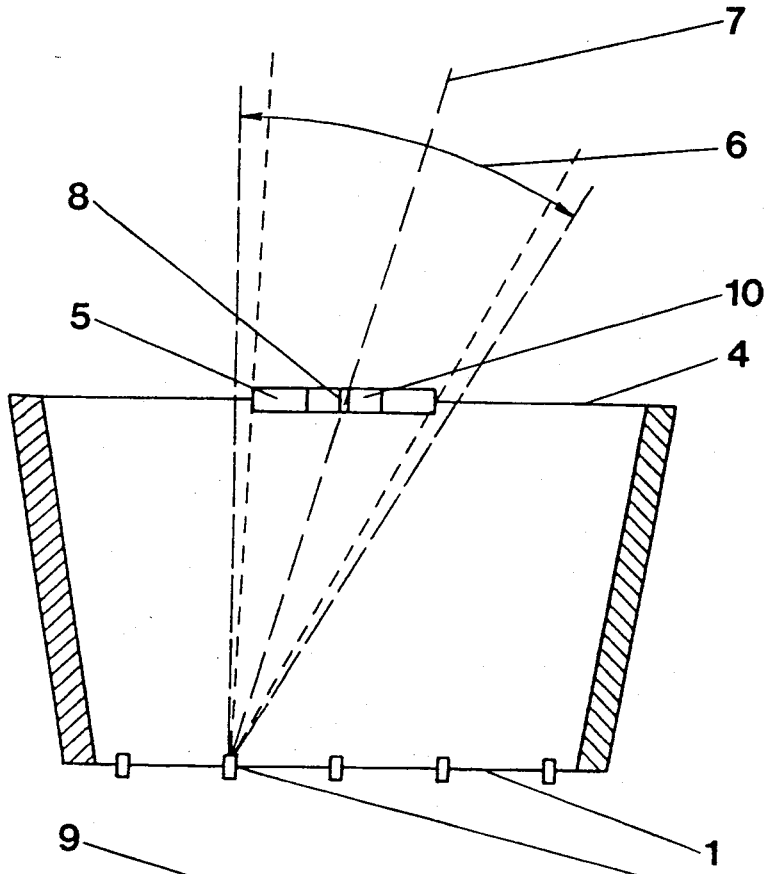
FIGS. 3 and 4 are diagrammatic presentations of another embodiment of the invention.
Figure 3:
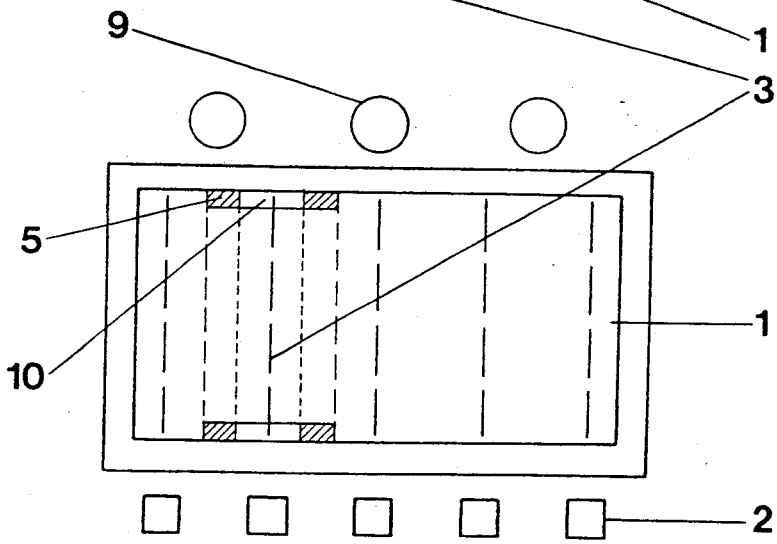

FIGS. 3 and 4 show an embodiment devised for the case that the sight aids in the entry window 1 consist of five sight aid lines 3.

Below each sight aid line 3 there is a key 2 associated with the respective direction 7 which is defined by the line of sight 8 in the exit window 4 and the respective sight aid line 3 in the entry window 1.

The key 2 may be pressed to release transmission of the particular direction 7 to the magnifying sight and/or the automatic running of the sight into this direction.

Figure 1:
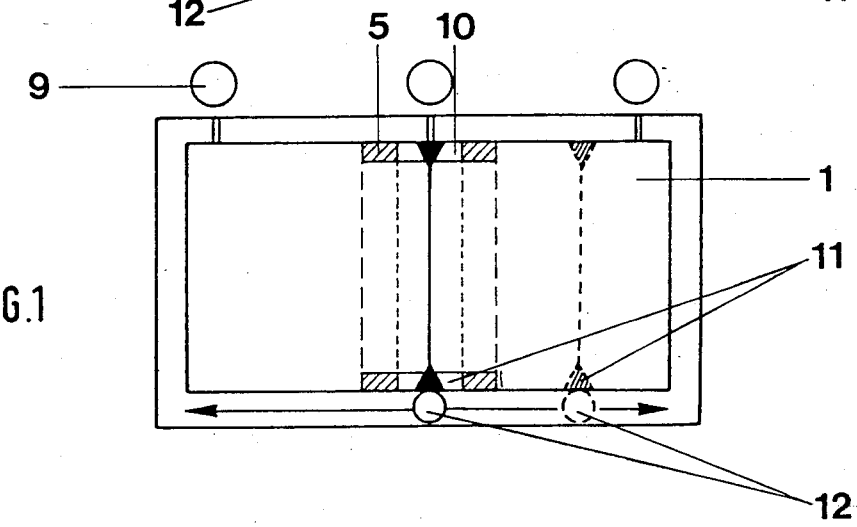

As for the further details, the same explanations apply that were made with reference to FIGS. 1 and 2.

What is claimed is:

1. A method of using an optical square to position a selected target in the field of view of a magnifying sight comprising the steps of:

(a) providing a magnifying sight having a predetermined magnification;

(b) providing an optical square having in an exit window thereof a vertical line as a sighting aid and having in an entry window thereof at least one selectively positionable indicator field of view related to the predetermined magnification of the magnifying sight;

(c) visually aligning the vertical line of the optical square on the line of sight between a selected target and the selectively positionable field of view indicator of the optical square by positioning the field of view indicator;

(d) providing a control signal in response to the position of the field of view indicator; and (e) positioning the magnifying sight responsively to the control signal so that the field of view of the magnifying sight will encompass the field of view indicated by the field of view indicator of the optical square.

2. The method of claim 1 wherein the magnification of the magnifying sight is selectively variable between two values;

wherein the field of view indicator of the optical square is selectively modified to indicate two different fields of view; and including the further step of selectively modifying the field of view indicator in the entry window of the optical square to conform to the selected value of magnification of the magnifying sight.

3. The method of claim 1 wherein the field of view indicator of the optical square includes field of view indications related to two different values of magnification of the magnifying sight; and wherein the value of magnification of the magnifying sight is selectively varied between two discrete values.

4. The method of claim 1 wherein sensing of the position of the field of view indicator is continuous; and wherein the positioning of the magnifying sight is automatically responsive to the control signal.

5. The method of claim 1 wherein the positioning of the magnifying sight is selectively responsive to the control signal.

* * * * *